US008773413B2

(12) United States Patent
Zhou

(10) Patent No.: US 8,773,413 B2
(45) Date of Patent: Jul. 8, 2014

(54) LIQUID CRYSTAL DISPLAY PANEL, LIQUID CRYSTAL DISPLAY DEVICE, AND GATE DRIVING METHOD OF LIQUID CRYSTAL DISPLAY PANEL

(75) Inventor: Xiufeng Zhou, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 201 days.

(21) Appl. No.: 13/376,083

(22) PCT Filed: Oct. 28, 2011

(86) PCT No.: PCT/CN2011/081466

§ 371 (c)(1),
(2), (4) Date: Dec. 2, 2011

(87) PCT Pub. No.: WO2013/037156

PCT Pub. Date: Mar. 21, 2013

(65) Prior Publication Data

US 2013/0063405 A1 Mar. 14, 2013

(30) Foreign Application Priority Data

Sep. 13, 2011 (CN) ..... 2011 1 0269659

(51) Int. Cl.
*G09G 5/00* (2006.01)
*G09G 3/36* (2006.01)

(52) U.S. Cl.
CPC ..... *G09G 3/3674* (2013.01); *G09G 2310/062* (2013.01); *G09G 2310/0251* (2013.01); *G09G 2310/0283* (2013.01); *G09G 2310/0289* (2013.01); *G09G 2310/0291* (2013.01); *G09G 2310/0286* (2013.01)
USPC ..... 345/204; 345/100

(58) Field of Classification Search
CPC ..... G09G 3/3677
USPC ..... 345/100, 204, 211, 212, 55, 87, 89, 92, 345/98, 46
See application file for complete search history.

(56) References Cited

U.S. PATENT DOCUMENTS 6,040,812 A * 3/2000 Lewis ..... 345/89
6,611,261 B1 * 8/2003 Zhang et al. ..... 345/204
(Continued)

FOREIGN PATENT DOCUMENTS

CN 1410956 A 4/2003
CN 1011788879 A * 10/2005 ..... G09G 3/36
(Continued)

OTHER PUBLICATIONS

Luo Peng, the first office action, Aug. 2012, CN.
(Continued)

*Primary Examiner* — Sumati Lefkowitz
*Assistant Examiner* — Peijie Shen
(74) *Attorney, Agent, or Firm* — IPro, Inc.; Na Xu

(57) ABSTRACT

An LCD panel includes multiple gate lines, and a gate drive circuit connected with the gate lines. The gate drive circuit includes multiple shift register units which are used for outputting shifting signals to sequentially drive all gate lines; each shift register unit includes a first output interface and a second output interface which are connected with adjacent two gate lines. The first output interface outputs a first gate signal, the second output interface outputs a second gate signal; and a duration of the second gate signal is two times of a duration of the first gate signal in a scanning period.

10 Claims, 10 Drawing Sheets

(56) References Cited

U.S. PATENT DOCUMENTS

| | | | | |
|---|---|---|---|---|
| 6,630,920 | B1 * | 10/2003 | Maekawa et al. | 345/100 |
| 7,256,759 | B2 * | 8/2007 | Kim et al. | 345/87 |
| 7,911,436 | B2 * | 3/2011 | Lee et al. | 345/100 |
| 2001/0013852 | A1 * | 8/2001 | Matsushima et al. | 345/92 |
| 2003/0090614 | A1 | 5/2003 | Kim et al. | |
| 2003/0231735 | A1 | 12/2003 | Moon et al. | |
| 2005/0141320 | A1 * | 6/2005 | Senda | 365/226 |
| 2005/0264551 | A1 * | 12/2005 | Hsieh et al. | 345/204 |
| 2005/0275614 | A1 * | 12/2005 | Kim et al. | 345/100 |
| 2007/0290977 | A1 * | 12/2007 | Cheng et al. | 345/98 |
| 2008/0165112 | A1 * | 7/2008 | Su | 345/100 |
| 2008/0266477 | A1 * | 10/2008 | Lee et al. | 349/46 |
| 2010/0001929 | A1 * | 1/2010 | Kawabe | 345/55 |
| 2011/0128259 | A1 * | 6/2011 | Suzuki et al. | 345/204 |
| 2011/0205196 | A1 * | 8/2011 | Okuno et al. | 345/204 |
| 2012/0075279 | A1 * | 3/2012 | Ishida | 345/211 |

FOREIGN PATENT DOCUMENTS

| | | | | |
|---|---|---|---|---|
| CN | 1779752 | A | 5/2006 | |
| CN | 1011788879 | A * | 10/2006 | G09G 3/36 |
| CN | 101178879 | A | 5/2008 | |
| CN | 101295481 | A | 10/2008 | |
| CN | 102368380 | A | 3/2012 | |
| CN | 101477836 | B | 4/2012 | |

OTHER PUBLICATIONS

Luo Peng, the second office action, Mar. 2013, CN.

Liu Chang, the International Searching Authority written comments, Jun. 2012, CN.

* cited by examiner

LIQUID CRYSTAL DISPLAY PANEL, LIQUID CRYSTAL DISPLAY DEVICE, AND GATE DRIVING METHOD OF LIQUID CRYSTAL DISPLAY PANEL

TECHNICAL FIELD

The present invention relates to the field of liquid crystal displays (LCDs), and more particularly to a LCD panel, a LCD device, and a gate driving method of LCD panel.

BACKGROUND

It is well-known that the technique of gate on array (GOA)/gate in TFT-LCD panel (GIP) can reduce integrated circuit (IC) cost, reduce the board area around a panel, and reduce the Tact time of MOD Bonding. However, the stability, the reliability, the power consumption, etc. of the complicated GOA circuits of the panel become problems which are difficult to solve for designers. One gate line signal is output by a general GOA circuit through at least one shift register unit. Thus, for n gate lines, more than n+1 shift register units are required to form a completed circuit loop structure. Because external CLK and VGL lines enter the more than n+1 shift register units simultaneously in accordance with requirements, the power consumption and delay of signals become more serious.

SUMMARY

The aim of the present invention is to provide a LCD panel, a LCD device, and a gate driving method of LCD panel capable of reducing the board area around a panel, reducing the Tact time of MOD Bonding, increasing the stability and reliability of the GOA circuits of the panel, and reducing the power consumption and delay of signals.

The purpose of the present invention is achieved by the following technical schemes.

A LCD panel comprises multiple gate lines, and a gate drive circuit connected with the gate lines; the gate drive circuit comprises multiple shift register units which are used for shifting signals to sequentially drive all the gate lines; each shift register unit comprises a former signal GOUT(n−1) interface and a latter signal GOUT(n) interface which are connected with adjacent two gate lines; the GOUT(n) output by the GOUT(n) interface exceeds the GOUT(n−1) output by the GOUT(n−1) interface at one scanning interval.

Preferably, the LCD panel also comprises a first switch circuit and a second switch circuit, and GOUT(n−1) interface shares a common interface with the GOUT(n) interface. A common signal output by the common interface is used as GOUT(n−1) or GOUT(n) to be output to the corresponding gate line, and is connected to the other adjacent gate line through the first switch circuit. This is a specific embodiment of the present invention. An output interface is shared by the GOUT(n−1) and the GOUT(n), and the output interval is controlled by the first switch circuit so that the circuit structure is simple.

Preferably, the common signal output by the common interface is kept for two scanning intervals within one scanning period; and the first switch circuit is kept for one scanning interval. This is a specific control mode of the GOUT(n−1)/GOUT(n) output. Take the common signal as GOUT(n) for example, the GOUT(n−1) is taken from the GOUT(n). To ensure that the GOUT(n) exceeds the GOUT(n−1) at one scanning interval, the GOUT(n) must be kept for more than two scanning intervals. Thus, two scanning intervals are preferable. The GOUT(n) output is kept for two scanning intervals, and the GOUT(n) exceeds the GOUT(n−1) at one scanning interval. Therefore, the first switch circuit should be connected when a high-level signal is output by the GOUT(n) interface, and disconnected after being kept for one scanning interval. In addition, in the application of a large panel, the problem of undercharge may occur. The GOUT(n) is kept for two scanning intervals within one scanning period, and the gate lines are pre-charged in the former scanning interval, to ensure a pixel to achieve the required potential within defined time.

Preferably, the LCD panel also comprises a first switch circuit, and the GOUT(n) interface shares a common interface with the GOUT(n−1) interface. The common interface is used as a GOUT(n−1) or GOUT(n) interface to output a signal to the corresponding gate line, and is connected to the other adjacent gate line by the first switch circuit; and the other adjacent gate line is connected to the reference low-level signal of the shift register unit by the second switch circuit. This is the other embodiment of the present invention. The reliability becomes higher because the output interval of the common signal output to the other gate line is controlled by two switch circuits.

Preferably, the common signal is kept for two scanning intervals within one scanning period. The first switch circuit and the second switch circuit are alternatively connected, and are connected for one scanning interval each time. This is the other specific control mode of the GOUT(n−1)/GOUT(n) output. Take the common signal as GOUT(n−1) for example, the GOUT(n−1) is taken from the GOUT(n). To ensure that the GOUT(n) exceeds the GOUT(n−1) at one scanning interval, the GOUT(n) must be kept for more than two scanning intervals. Thus, two scanning intervals are preferable. The first switch circuit and the second switch circuit are respectively used for connecting and disconnecting the GOUT(n−1). The GOUT(n) output is kept for two scanning intervals, and the GOUT(n) exceeds the GOUT(n−1) at one scanning interval. Therefore, the first switch circuit should be connected when a high-level signal is output by the GOUT(n) interface, and disconnected after being kept for one scanning interval. To ensure the reliability of actions, when the first switch circuit is disconnected, the second switch circuit is connected, and the GOUT(n−1) is forcibly kept at a low-level position.

Preferably, the common signal is output by the common interface through a third switch circuit, and the control ends of the second switch circuit and the third switch circuit are connected to the same control signal. The third switch circuit can ensure that the scanning of the other gate line is in an off state when the current gate line is scanned. Thus, the scanning interval of every two gate lines is guaranteed as one scanning interval, benefitting to keep the scanning consistency of gate lines and improve display quality.

Preferably, the LCD panel also comprises an intensifier circuit; the intensifier circuit is connected to the other end of the gate line, and is matched with the gate drive circuit to simultaneously drive and scan the same gate line. The intensifier circuit is added, and then the drive capability of each gate line is improved.

Preferably, the structure of the intensifier circuit at the other end of the gate line is completely the same as that of the gate drive circuit at one end of the gate line. This is one specific embodiment of the intensifier circuit.

Preferably, the intensifier circuit is a buffer circuit, and the buffer circuit comprises multiple buffer units. Each buffer unit comprises a fourth switch circuit and a fifth switch circuit which are in series connection. The input end of the fourth switch circuit is connected with a gate line corresponding to the common signal, and the output end of the fourth switch circuit is connected with a gate line corresponding to the output end of the first switch circuit, and is connected with a reference low-level signal of the intensifier circuit through the fifth switch circuit. A same control signal is used by the fourth switch circuit and the first switch circuit. A same control signal is used by the fifth switch circuit and the second switch circuit. This is the other specific embodiment of the intensifier circuit so that the circuit has simple structure and low cost.

A LCD device, wherein the LCD device comprises the aforementioned LCD panel.

A gate driving method of LCD panel, comprising the following steps: selecting multiple shift register units which are used for shifting signals to sequentially drive all the gate lines; connecting each shift register unit with adjacent two gate lines; and outputting GOUT(n−1) and GOUT(n) between which one scanning interval exists by each shift register unit to its corresponding adjacent two gate lines.

Preferably, the GOUT(n) is kept for two scanning intervals. The GOUT(n−1) is connected with the GOUT(n) by the first switch circuit, and is connected with the Voff of the shift register unit by the second switch circuit. The first switch circuit and the second switch circuit are alternatively connected, and are connected for one scanning interval each time.

In the present invention, each shift register unit can scan two gate lines. N Gate line signals are output by only at least n/2+1 shift register units. The circuit is greatly simplified; the RC distortion of input clock signals is reduced; the signal delay effect is greatly reduced; and the reliability and stability of circuits are increased. Meanwhile, on the premise of guaranteeing circuit drive, the GOA circuit is further simplified, and the space occupied by the circuit is further reduced.

Wherein: 1. LCD panel; 2. gate drive circuit; 21. shift register unit; 3. liquid crystal drive IC (COF); 4. first switch circuit; 5. second switch circuit; 6. third switch circuit; 7. intensifier circuit; 8. buffer unit; 81. fourth switch circuit; 82. fifth switch circuit.

DETAILED DESCRIPTION

The present invention will further be described in detail in accordance with the figures and the preferred embodiments.

Figure 1:
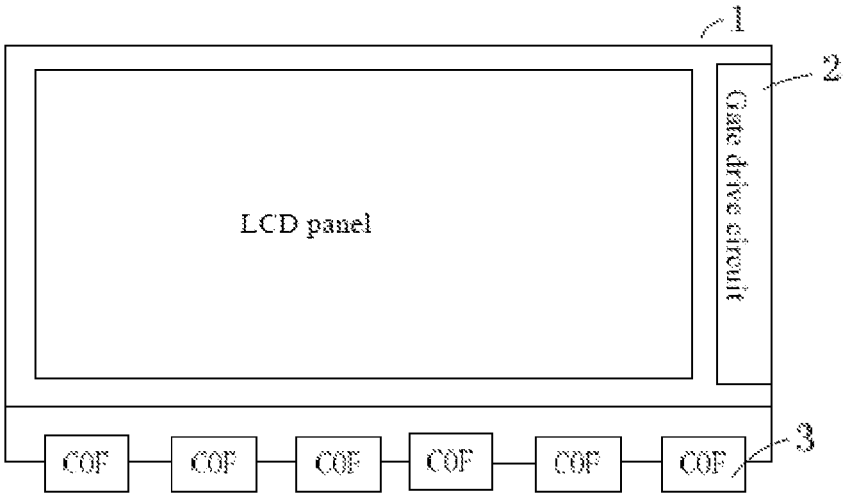
FIG. 1 is a schematic diagram of a LCD panel of the present invention.
Figure 2:
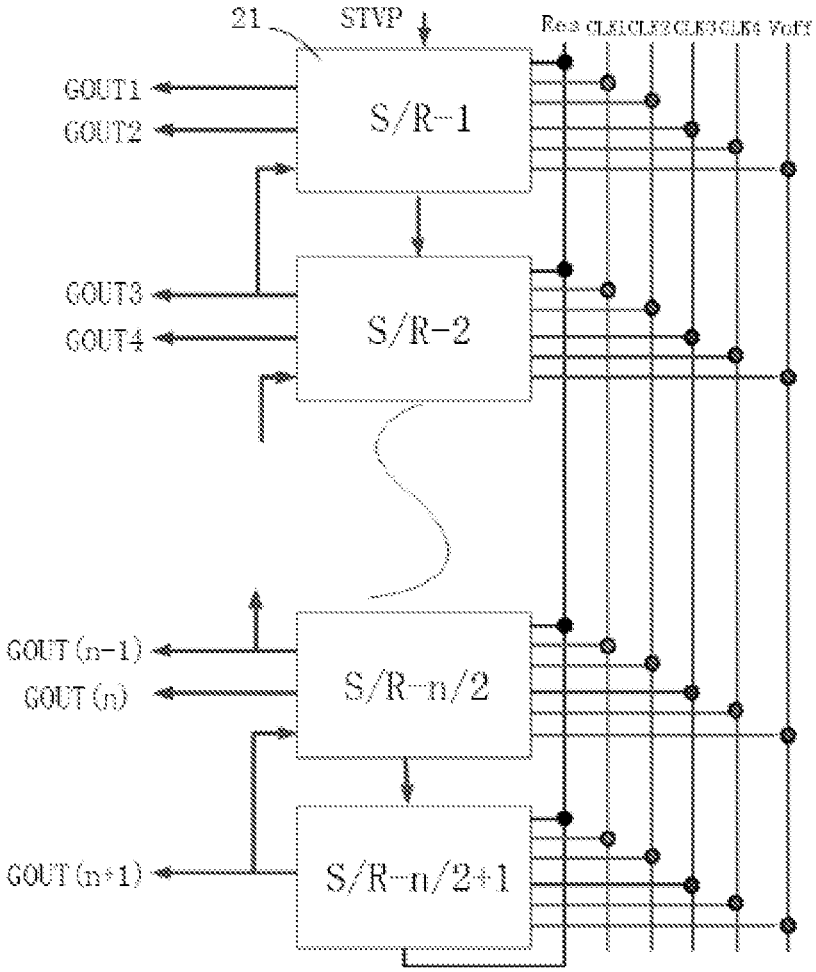
FIG. 2 is a schematic diagram of a principle conception of the present invention.

A LCD device comprises a LCD panel. As shown in FIG. 1 and FIG. 2, the LCD panel 1 comprises multiple gate lines and data lines (arranged on the LCD panel 1 and not shown in the figure), a gate drive circuit 2 connected with the gate lines, and liquid crystal drive ICs (COF) 3 connected with the data lines. The gate drive circuit 2 comprises multiple shift register units 21. Each shift register unit 21 comprises a GOUT(n−1) interface and a GOUT(n) interface which are connected with adjacent two gate lines; the GOUT(n) output by the GOUT(n) interface exceeds the GOUT(n−1) output by the GOUT(n−1) interface at one scanning interval. The scanning interval refers to the average scanning time of all gate lines within one scanning period. The invention will further be described in detail in accordance the embodiments.

Figure 3:
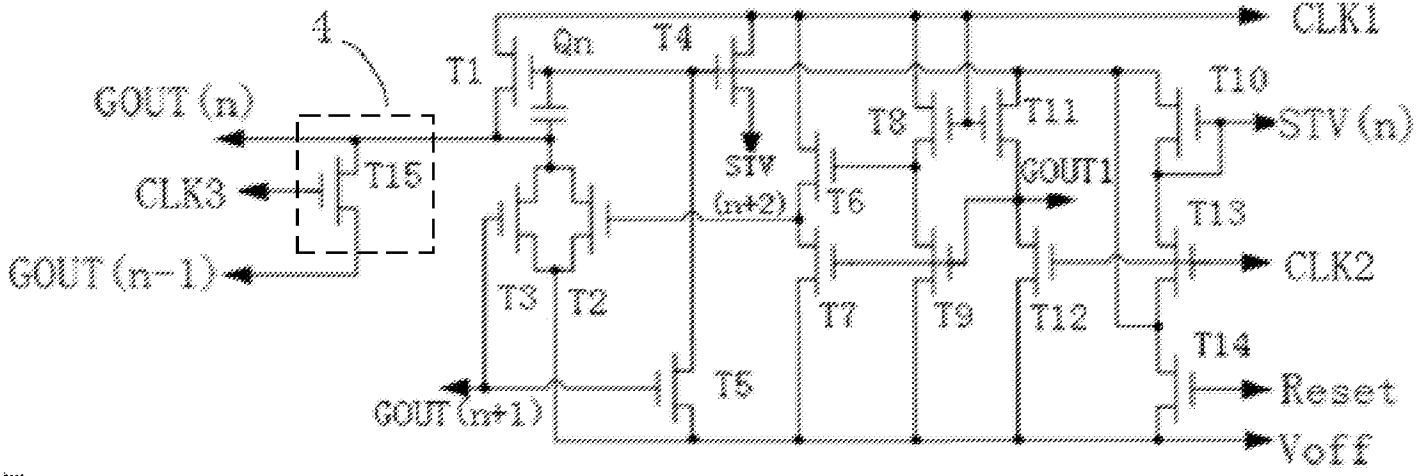
FIG. 3 is a functional block diagram of embodiment 1 of the present invention.

Embodiment 1: as shown in FIG. 3, the GOUT(n−1) interface shares a common interface with the GOUT(n) interface. A common signal output by the common interface is used as GOUT(n−1) or GOUT(n) to be output to the corresponding gate line, and is connected to the other adjacent gate line through a first switch circuit 4.

The common signal output by the common interface is kept for two scanning intervals within one scanning period, and the first switch circuit is kept for one scanning interval. Take the common signal as GOUT(n) for example, the GOUT(n−1) is taken from the GOUT(n). To ensure that the GOUT(n) exceeds the GOUT(n−1) at one scanning interval, the GOUT (n) must be kept for more than two scanning intervals. Thus, two scanning intervals are preferable. The GOUT(n) output is kept for two scanning intervals, and the GOUT(n) exceeds the GOUT(n−1) at one scanning interval. Therefore, the first switch circuit 4 should be connected when a high-level signal is output by the GOUT(n) interface, and disconnected after being kept for one scanning interval.

An output interface is shared by the GOUT(n) and the GOUT(n−1), and the output interval is controlled by the first switch circuit 4 so that the circuit structure is simple.

Figure 4:
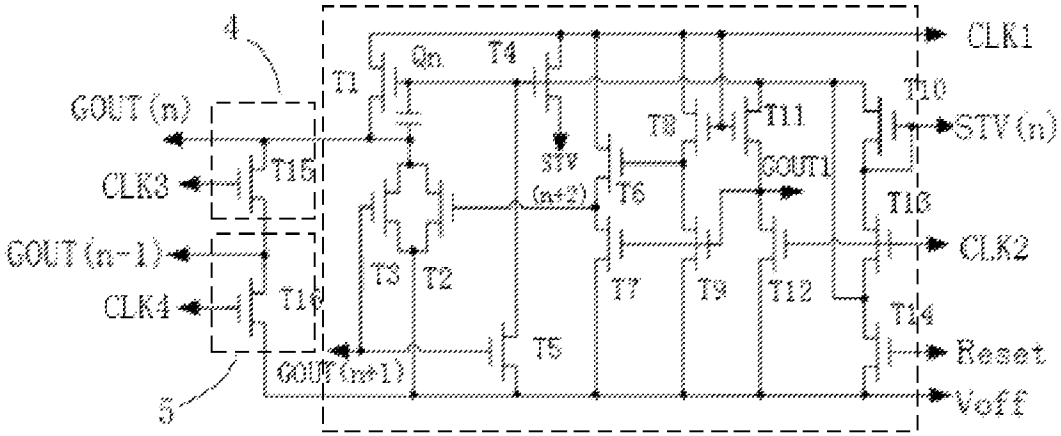
FIG. 4 is a functional block diagram of embodiment 2 of the present invention.
Figure 5:
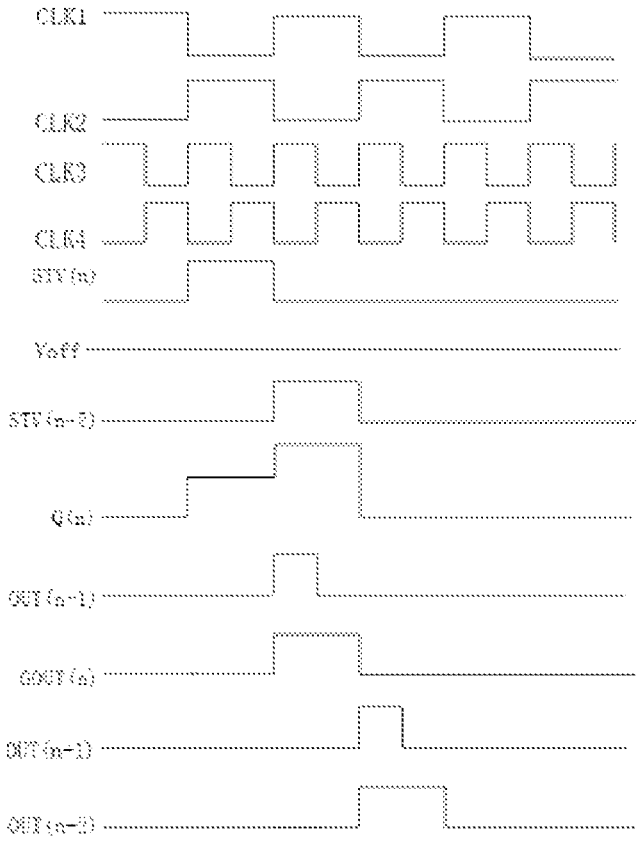
FIG. 5 is a waveform diagram of the input and output signals of embodiment 2 of the present invention.

Embodiment 2: as shown in FIG. 4 and FIG. 5, a common interface is shared by the GOUT(n−1) interface and the GOUT(n) interface. The common interface is used as a GOUT(n−1) interface or a GOUT(n) interface to output a signal to the corresponding gate line, and is connected to the other adjacent gate line by the first switch circuit 4; and the other adjacent gate line is connected to the reference low-level signal Voff of the shift register unit 21 by the second switch circuit 5. The common signal is kept for two scanning intervals within one scanning period. The first switch circuit 4 and the second switch circuit 5 are alternatively connected, and are connected for one scanning interval each time. Take the common signal as GOUT(n) for example:

The GOUT(n−1) is taken from the GOUT(n). To ensure that the GOUT(n) exceeds the GOUT(n−1) at one scanning interval, the GOUT(n) must be kept for more than two scanning intervals. Thus, two scanning intervals are preferable. The first switch circuit 4 and the second switch circuit 5 are respectively used for controlling the connection and the disconnection of the GOUT(n−1). The GOUT(n) output is kept for two scanning intervals. The GOUT(n) exceeds the GOUT (n−1) at one scanning interval. Therefore, the first switch circuit 4 should be connected when a high-level signal is output by the GOUT(n) interface, and is disconnected after being kept for one scanning interval. To ensure the reliability of actions, when the first switch circuit 4 is disconnected, the second switch circuit 5 is connected, and the GOUT(n−1) is forcibly kept at a low-level position. In the application of a large panel, the problem of undercharge may occur. Therefore, corresponding gate lines should be pre-charged to ensure a pixel to achieve the required potential within defined time. The GOUT(n) exceeds the GOUT(n−1) at one scanning interval, and the signal output is kept in one scanning interval when the GOUT(n−1) is output to pre-charge the corresponding gate line. Therefore, the GOUT(n) is kept for two scanning intervals within one scanning period.

As shown in the functional block diagram of FIG. 4: the first switch circuit 4 is a switch tube T15, and the second switch circuit 5 is a switch tube T16. A chip select (CS) STV is externally provided by the circuit to control clock signals (CLK1,CLK2,CLK3,CLK4), and the reference low-level signal Voff of the shift register unit 21. The GOUT(n), the STV(n) of the following shift register unit 21 and the GOUT (n−1) are output through the aforementioned function modules. The switch tube T1 and the switch tube T15 are pull-up units and output the GOUT(n) and GOUT(n−1), and the switch tube T4 is a carry unit and outputs STV(n+2). Switch tubes T2, T6, T7, T8, T9 and T11 are holding units, and hold the Gate out output to the required potential; switch tubes T3, T5, T12, T13 and T16 are discharge units, and pull down high potential to low potential; and a switch tube T14 is a discharge reset unit.

The current shift register unit 21 accepts the CS STV(n) of the former shift register unit 21. Only after the STV(n) is accepted, the output of the current shift register unit 21 is controlled. If the current shift register unit 21 is the first shift register unit 21, its STV(n) comes from an external enable pulse STVP. After the current shift register unit 21 is started, the level switch of the scanning signal GOUT(n) is controlled by CLK1 and CLK2, the GOUT(n−1) level switch is controlled by CLK3 and CLK4, and a reference low level is provided by Voff. Reset provides a reset signal, the high level is effective, and the data of all the shift register units are cleared. After the current shift register unit 21 drives the current gate line, a CS STV(n+2) of the following shift register unit 21 is produced; the following shift register unit 21 responds to CLK1 to CLK4 after starting; the GOUT(n+1) is fed back to the former shift register unit 21 when the current gate line is driven; the former shift register unit 21 is cleared and reset; and the former shift register unit 21 does not respond to the clock signals before the next STV(n) is produced.

This is the other embodiment of the present invention. The reliability becomes higher because the output interval of the common signal output to the other gate line is controlled by two switch circuits.

Figure 6:
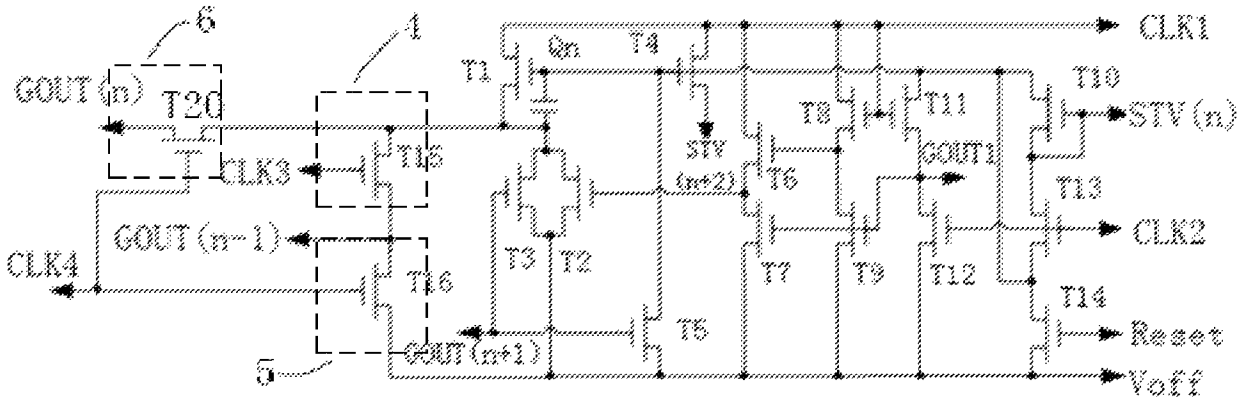
FIG. 6 is a functional block diagram of embodiment 3 of the present invention.

Embodiment 3: as shown in FIG. 6, the common signal is output by the common interface through a third switch circuit 6; and the control ends of the second switch circuit 5 and the third switch circuit 6 are connected to the same control signal. The embodiment can be used in the technical schemes of the aforementioned embodiment 1 and embodiment 2. To simplify description, take the application of embodiment 2 as an example to further describe the technical scheme: take the common signal as GOUT(n) for example, the GOUT(n) is output by the common interface through the third switch circuit 6. The GOUT(n) is kept for two scanning intervals, and the control end of the first switch circuit 4 is connected to the CLK3. The control ends of the second switch circuit 5 and the third switch circuit 6 are connected to the CLK4, and the first switch circuit 4 and the second switch circuit 5 are alternatively connected, and are connected for one scanning interval each time. The first switch circuit 4 is connected when a high-level signal is output by the GOUT(n) interface.

Figure 7:
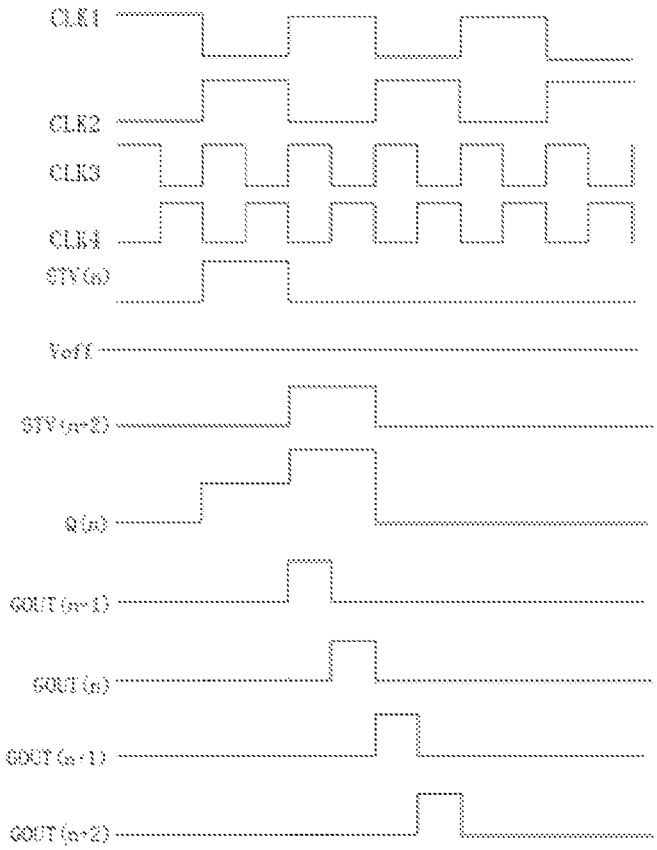
FIG. 7 is a waveform diagram of the input and output signals of embodiment 3 of the present invention.

As shown in FIG. 7, because the control ends of the second switch circuit 5 and the third switch circuit 6 are connected to the CLK4, when the GOUT(n−1) is output, the GOUT(n) output is in an off state. When the GOUT(n−1) is disconnected, the third switch circuit 6 is connected, and the GOUT (n) is output. Therefore, the output time of either the GOUT (n−1) or the GOUT(n) is one scanning interval. The equal scanning interval benefits to guarantee display consistency, and the preferable display quality of the LCD panel 1.

Figure 8:
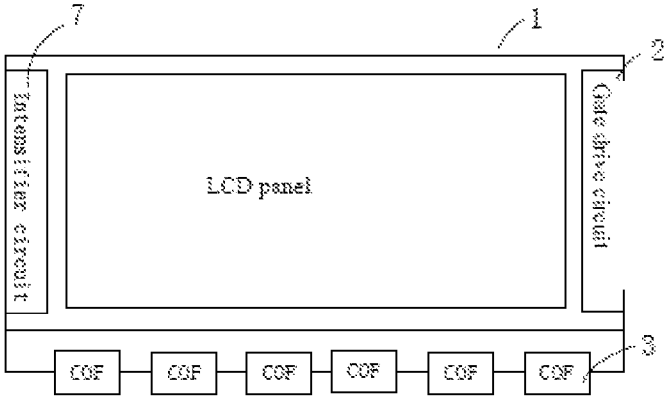
FIG. 8 is a schematic diagram of a LCD panel of embodiment 4 of the present invention.
Figure 9:
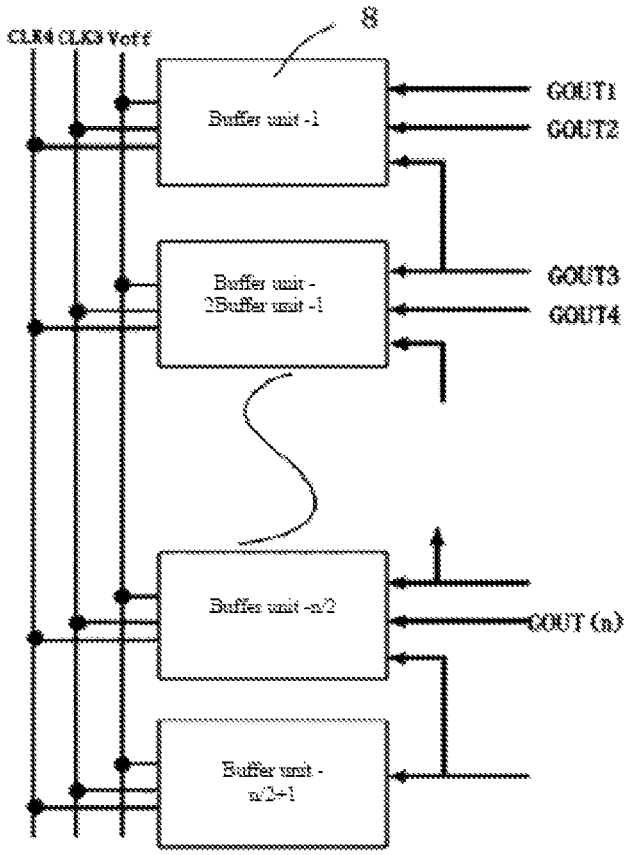
FIG. 9 is a principle diagram of embodiment 4 of the present invention.
Figure 10:
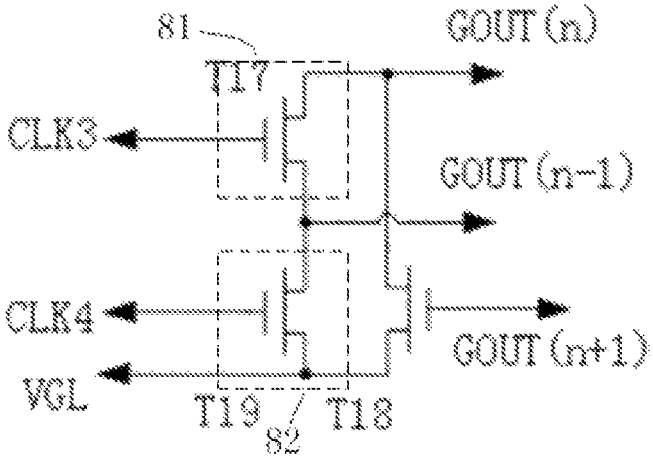
FIG. 10 is a principle diagram of a buffer unit of embodiment 4 of the present invention.

Embodiment 4: to preferably increase the speed of circuit charge and discharge, a design of drive of double sides is used; an intensifier circuit 7 on the left side may be designed with the same circuit structure as that of the gate drive circuit on the right side to improve the circuit drive capability; alternatively, the intensifier circuit 7 on the left side may be only designed into a buffer circuit for charge and discharge to improve the circuit drive capability. As shown in FIG. 8, the LCD panel 1 also comprises an intensifier circuit 7. The intensifier circuit 7 is connected to the other end of the gate line, and is matched with the gate drive circuit 2 to simultaneously drive and scan the same gate line. The embodiment can be used in any one of the technical schemes of the aforementioned embodiment 1 to embodiment 3. To simplify description, take the application of embodiment 2 as an example to further describe the technical scheme:

The embodiment uses the buffer circuit solution as an example to explain; as shown in FIG. 9 and FIG. 10, the intensifier circuit 7 comprises multiple buffer units 8. Each buffer unit 8 comprises a fourth switch circuit 81 and a fifth switch circuit 82 which are in series connection. The input end of the fourth switch circuit 81 is connected with a gate line corresponding to the common signal, and the output end of the fourth switch circuit 81 is connected with a gate line corresponding to the output end of the first switch circuit 4, and is connected with a reference low-level signal VGL of the intensifier circuit 7 through the fifth switch circuit 82. A same control signal is used by the fourth switch circuit 81 and the first switch circuit 4, namely the CLK3; and a same control signal is used by the fifth switch circuit 82 and the second switch circuit 5, namely the CLK4. Thus, the intensifier circuit 7 can simultaneously drive the corresponding gate line from the other end when driving the gate line from one end, so that the scanning drive capability of the gate line is enhanced.

Through the circuit, the left side and the right side of a circuit are simultaneously charged and discharged; the response speed of the circuit is rapidly increased; and the panel image quality uniformity is improved. The conception of the present invention is not limited to the aforementioned embodiments, all the intensifier circuits which are connected to the other end of each gate line, matched with the gate drive circuit, and used for synchronously driving and scanning the same gate line should be considered to belong to the protection scope of the present invention.

A gate driving method of LCD panel which is used by the aforementioned LCD panel, comprising the following steps: selecting multiple shift register units which are used for shifting signals to sequentially drive all gate lines; connecting each shift register unit with adjacent two gate lines; and outputting GOUT(n−1) and GOUT(n)1 between which one scanning interval exists by each shift register unit to its corresponding adjacent two gate lines.

Furthermore, the GOUT(n) is kept for two scanning intervals. The GOUT(n−1) is connected with the GOUT(n) by the first switch circuit, and is connected with the reference low-level signal Voff of the shift register unit by the second switch circuit. The first switch circuit and the second switch circuit are alternatively connected, and are connected for one scanning interval each time.

The present invention is described in detail in accordance with the above contents with the specific preferred embodiments. However, this invention is not limited to the specific embodiments. For the ordinary technical personnel of the technical field of the present invention, on the premise of keeping the conception of the present invention, the technical personnel can also make simple deductions or replacements, and all of which should be considered to belong to the protection scope of the present invention.

We claim:

1. A liquid crystal display (LCD) panel, comprising multiple gate lines, and a gate drive circuit connected with the gate lines; said gate drive circuit comprises multiple shift register units which are used for outputting shifting signals to sequentially drive all gate lines; each shift register unit comprises a first output interface and a second output interface which are connected with adjacent two gate lines; the first output interface outputting a first gate signal, the second output interface outputting a second gate signal; and a duration of the second gate signal is two times of a duration of the first gate signal in a scanning period; and wherein said LCD panel also comprises a first switch circuit and a second switch circuit, and said first output interface shares a common interface with said second output interface; said common interface is used as a first output interface or second output interface to output the first or second gate signal to the corresponding gate line and is connected to the other gate line of the two adjacent gate lines via the first switch circuit; and the other gate line of the two adjacent gate lines is connected to a reference low-level signal of said shift register unit via a second switch circuit.

2. The LCD panel of claim 1, wherein when the common interface outputs the second gate signal, the second gate signal is kept for two scanning intervals within one scanning period; said first switch circuit and the second switch circuit are alternatively connected, and are connected for one scanning interval each time.

3. The LCD panel claim of 1, wherein said LCD panel also comprises an intensifier circuit; said intensifier circuit is connected to the other end of said gate lines, and is matched with said gate drive circuit to simultaneously drive and scan a same gate line.

4. The LCD panel of claim 3, wherein a structure of the intensifier circuit at the other end of said gate lines is completely the same as that of the gate drive circuit at one end of said gate lines.

5. The LCD panel of claim 1, wherein said LCD panel also comprises an intensifier circuit; said intensifier circuit is connected to the other end of said gate lines, and is matched with said gate drive circuit to simultaneously drive and scan a same gate line; said intensifier circuit is a buffer circuit, and said buffer circuit comprises multiple buffer units; each said buffer unit comprises a fourth switch circuit and a fifth switch circuit which are connected in series; an input end of said fourth switch circuit is connected with a gate line corresponding to said common signal; the output end of said fourth switch circuit is connected with a gate line corresponding to the output end of said first switch circuit, and is connected with a reference low-level signal of said intensifier circuit through the fifth switch circuit; a same control signal is used by said fourth switch circuit and said first switch circuit; a same control signal is used by said fifth switch circuit and said second switch circuit.

6. An LCD device, comprising: an LCD panel; said LCD panel comprises multiple gate lines, and a gate drive circuit connected with the gate lines; said gate drive circuit comprises multiple shift register units which are used for outputting shifting signals to sequentially drive all gate lines; each shift register unit comprises a first output interface and a second output interface which are connected with adjacent two gate lines; the first output interface outputting a first gate signal, the second output interface outputting a second gate signal; and a duration of the second gate signal is two times of a duration of the first gate signal in a scanning period; and wherein said LCD panel also comprises a first switch circuit and a second switch circuit, and said first output interface shares a common interface with said second output interface; said common interface is used as a first output interface or second output interface to output the first or second gate signal to the corresponding gate line and is connected to the other gate line of the two adjacent gate lines via the first switch circuit; and the other gate line of the two adjacent gate lines is connected to a reference low-level signal of said shift register unit via a second switch circuit.

7. The LCD device of claim 6, wherein when the common interface outputs the second gate signal, the second gate signal is kept for two scanning intervals within one scanning period; said first switch circuit and the second switch circuit are alternatively connected, and are connected for one scanning interval each time.

8. The LCD device of claim of 6, wherein said LCD panel also comprises an intensifier circuit; said intensifier circuit is connected to the other end of said gate lines, and is matched with said gate drive circuit to simultaneously drive and scan a same gate line.

9. The LCD device of claim 8, wherein a structure of the intensifier circuit at the other end of said gate lines is completely the same as that of the gate drive circuit at one end of said gate lines.

10. The LCD device of claim 6, wherein said LCD panel also comprises an intensifier circuit; said intensifier circuit is connected to the other end of said gate lines, and is matched with said gate drive circuit to simultaneously drive and scan a same gate line; said intensifier circuit is a buffer circuit, and said buffer circuit comprises multiple buffer units; each said buffer unit comprises a fourth switch circuit and a fifth switch circuit which are connected in series; an input end of said fourth switch circuit is connected with a gate line corresponding to said common signal; the output end of said fourth switch circuit is connected with a gate line corresponding to the output end of said first switch circuit, and is connected with a reference low-level signal of said intensifier circuit through the fifth switch circuit; a same control signal is used by said fourth switch circuit and said first switch circuit; a same control signal is used by said fifth switch circuit and said second switch circuit.

* * * * *